US009929473B2

(12) United States Patent
Huang et al.

(10) Patent No.: US 9,929,473 B2
(45) Date of Patent: Mar. 27, 2018

(54) ANTENNA FOR MOBILE COMMUNICATION DEVICE

(71) Applicant: Acer Incorporated, New Taipei (TW)

(72) Inventors: Shih-Ting Huang, New Taipei (TW); Kun-Sheng Chang, New Taipei (TW); Ching-Chi Lin, New Taipei (TW)

(73) Assignee: Acer Incorporated, New Taipei (TW)

( * ) Notice: Subject to any disclaimer, the term of this patent is extended or adjusted under 35 U.S.C. 154(b) by 139 days.

(21) Appl. No.: 14/927,808

(22) Filed: Oct. 30, 2015

(65) Prior Publication Data

US 2017/0033467 A1 Feb. 2, 2017

(30) Foreign Application Priority Data

Jul. 31, 2015 (TW) ..... 104125035 A

(51) Int. Cl.

| | |
|---|---|
| ***H01Q 1/24*** | (2006.01) |
| ***H01Q 13/10*** | (2006.01) |
| ***H01Q 5/357*** | (2015.01) |
| ***H01Q 5/50*** | (2015.01) |

(52) U.S. Cl.

CPC ..... *H01Q 13/106* (2013.01); *H01Q 1/243* (2013.01); *H01Q 5/357* (2015.01); *H01Q 5/50* (2015.01)

(58) Field of Classification Search

CPC ..... H01Q 1/24; H01Q 5/50
USPC ..... 343/702
See application file for complete search history.

(56) References Cited

U.S. PATENT DOCUMENTS

| | | | | |
|---|---|---|---|---|
| 7,388,553 | B2 * | 6/2008 | Yuanzhu | H01Q 9/0457 343/770 |
| 2003/0174092 | A1 * | 9/2003 | Sullivan | H01Q 1/243 343/702 |
| 2003/0189522 | A1 * | 10/2003 | Zeilinger | H01Q 9/0421 343/702 |
| 2004/0125029 | A1 * | 7/2004 | Maoz | H01Q 1/242 343/702 |
| 2006/0077113 | A1 * | 4/2006 | Yuanzhu | H01Q 9/0457 343/770 |
| 2006/0132362 | A1 * | 6/2006 | Yuanzhu | H01Q 1/36 343/700 MS |
| 2007/0171140 | A1 * | 7/2007 | Minard | H01Q 1/2275 343/770 |
| 2008/0284670 | A1 * | 11/2008 | Kanno | H01Q 13/106 343/767 |
| 2010/0085262 | A1 * | 4/2010 | Wolf | H01Q 3/24 343/768 |
| 2011/0300907 | A1 * | 12/2011 | Hill | H01Q 9/285 455/566 |
| 2012/0098721 | A1 * | 4/2012 | Wong | H01Q 1/243 343/749 |
| 2014/0078008 | A1 * | 3/2014 | Kang | H01Q 5/35 343/702 |

(Continued)

*Primary Examiner* — Huedung Mancuso
(74) *Attorney, Agent, or Firm* — Edell, Shapiro & Finnan, LLC

(57) ABSTRACT

An antenna includes a metal member, a closed slot disposed in the metal member, and a feed element having a first feed portion and a second feed portion, the first and second feed portions crossing the closed slot, and being electrically connected to each other. The feed element enables the closed slot to resonate at two different frequency bands and enables both bands to be individually tunable. The antenna can be incorporated into a metal cover or case of a mobile communication device.

18 Claims, 3 Drawing Sheets

(56) References Cited

U.S. PATENT DOCUMENTS

2014/0125528 A1* 5/2014 Tsai ..... H01Q 13/106
343/702
2015/0091763 A1* 4/2015 Lo Hine Tong ..... H01Q 1/24
343/702

* cited by examiner

ANTENNA FOR MOBILE COMMUNICATION DEVICE

This application claims priority under 35 U.S.C. § 119 to Taiwan patent application TW 104125035, filed on Jul. 31, 2015, the disclosure of which is incorporated herein by reference in its entirety.

TECHNICAL FIELD

Embodiments of the present invention are directed to an antenna for an electronic mobile communication device.

BACKGROUND

In recent years, the design of mobile communication devices has become increasingly important. One feature that has become particularly popular is that of a metal cover. Such metal covers, however, can influence the radio frequency (RF) characteristics of an internal antenna of the mobile communication device.

In this regard, most mobile communication devices employ a slot type antenna. And, in order to reduce the size of such an antenna, it is typical to employ a single closed slot antenna design. A single slot design, however, can only produce a single resonant mode. As a result, where, e.g., a second, higher, band is desired for RF communication, a second harmonic generated by the slot antenna can be leveraged. Such an arrangement, however, leaves little overall control over the characteristics of the higher band, and any tuning of the lower band will almost necessarily impact the performance of the second, higher, band.

Stated alternatively, with a conventional single closed slot antenna, a low band and high band will influence each other's overall tuning. That is, with a conventional single closed slot antenna a second, higher, band cannot be independently controlled, thus reducing the communication quality of mobile communication devices with such antenna designs.

SUMMARY

In accordance with an embodiment of the present invention, there is provided an antenna including a metal member, a closed slot disposed in the metal member, and a feed element having a first feed portion and a second feed portion, the first and second feed portions crossing the closed slot, and being electrically connected to each other.

The feed element may comprise a substrate, a first surface of the substrate having the first feed portion and the second portion disposed thereon, and a second surface of the substrate being in contact with the metal member.

The antenna may further include a shorting member that electrically connects the second feed portion to the metal member.

The first feed portion may be L-shaped and the second feed portion may have a linear shape.

The second feed portion operates to split the closed slot into a first slot and a second slot, the first slot and the second slot being configured to resonate together at a first resonant frequency, and the second slot being configured to resonate at a second resonant frequency higher than the first resonant frequency.

The first feed portion may comprise a feed point configured to receive a feed signal that drives the closed slot.

The antenna may alternatively comprise a shorting member that electrically connects the second feed portion to the metal member, and a third feed portion electrically connected to the first feed portion and comprising a segment that is spaced from the shorting member by a spacer.

The antenna may still further comprise a fourth feed portion that extends parallel to the closed slot.

In one implementation, at least one of the resonant frequencies falls within a frequency band in which communication according to the IEEE 802.11ac standard operates.

The second feed portion may alternatively have a nonlinear shape, and a segment thereof may extend parallel to the closed slot.

The metal member may be, or may be a part of, a cover of a mobile communication device.

BRIEF DESCRIPTION OF THE DRAWINGS

Embodiments are described herein in conjunction with the accompanying drawings, in which.

DESCRIPTION OF EXAMPLE EMBODIMENTS

Figure 1:
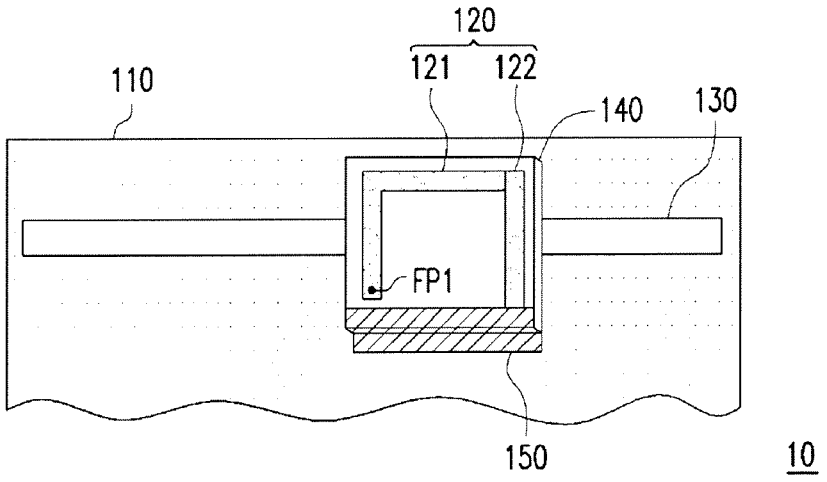
FIG. 1 is a perspective view of a mobile communication device antenna according to an embodiment of the present invention.

FIG. 1 is a perspective view of a mobile communication device having an antenna according to an embodiment of the present invention. As shown in FIG. 1, mobile communication device antenna 10 includes a metal member 110 and a feed element 120. Metal member 110 has a substantially planar configuration, and includes a closed slot 130. More specifically, metal member 110 may be, for example, a part of a metal cover, and metal member 110 may be, for example, attached to a housing of the mobile communication device 10. As noted, a metal cover for mobile communication devices is presently a popular design choice.

Feed element 120 includes a first feed portion 121 and a second feed portion 122. As can be seen in the drawing, feed element 120 is disposed over or above metal member 110. For example, mobile communication device antenna 10 includes a substrate 140, which includes opposing first (top) and second (bottom) surfaces. As shown, feed element 120 is disposed on the first (top) surface of substrate 140, and metal member 110 faces the second (bottom) surface of substrate 140.

First feed portion 121 has, at one end, feed point FP1, and is electrically connected on a second end to a first end of the second feed portion 122. A second end of second feed portion 122 is electrically connected to metal member 110 via, e.g., a shorting element 150 that can also be used to fix substrate 140 to metal member 110. More specifically, part of shorting member 150 (e.g., a metal tab extending parallel to the first and second surfaces of substrate 140) is disposed on the first surface of substrate 140, down a side edge between the first and second surfaces, and then parallel to a surface of metal member 110. That is, shorting member 150 is attached to metal member 110 and substrate 140, and is used to electrically (and also perhaps physically) connect metal member 110 to a second end of second feed portion 122.

Figure 2:
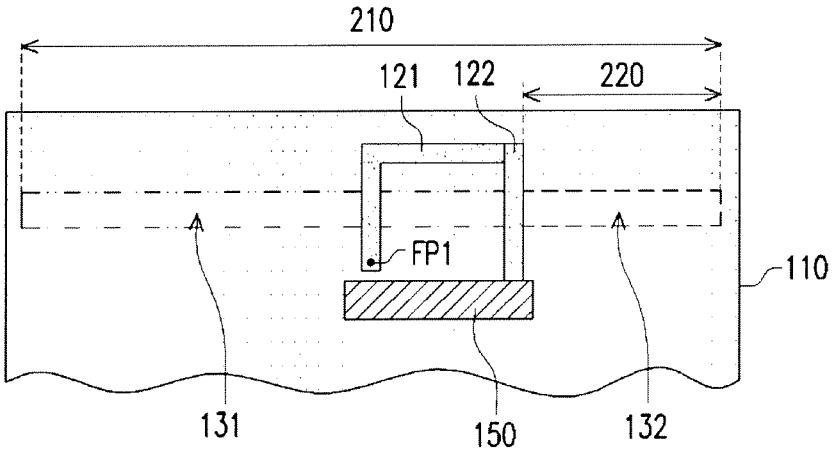
FIG. 2 is a schematic diagram of the mobile communication device antenna of FIG. 1.

FIG. 2 is a schematic diagram of mobile communication device antenna 10 of FIG. 1. As shown, segments of second feed portion 122 are disposed across closed slot 130. As a result, closed slot 130 can be considered to be divided into a first slot 131 and a second slot 132. Specifically, second feed portion 122 is disposed perpendicularly across closed slot 130. In addition, first slot 131 and second slot 132, respectively, have an open end and a closed end, and the open ends of first slot 131 and second slot 132 are shared with one another. Furthermore, second feed portion 122 is shown to overlap open ends of first slot 131 and second slot 132. A segment of first feed portion 121 is also disposed across first slot 131.

In operation, a feed signal is delivered to feed point FP1 of first feed portion 121. The signal may be provided, for example, by a transceiver (not shown) associated with mobile communication device antenna 10 via a coaxial cable. In such an arrangement, an inner conductor of the coaxial cable is electrically connected to feed point FP1 and an outer conductor of the coaxial cable is electrically connected to shorting element 150. In this way, feeding element 120 uses the feed signal to excite metal member 110's slot 130, to cause the slot antenna to resonate in multiple modes, thereby enabling the slot antenna to cover multiple bands.

More specifically, a combination of first slot 131 and second slot 132 may act to form a first resonance path 210, and second slot 132 may act to form a second resonance path 220. First resonant path 210 may be resonant with a first band (e.g., a low band), and second resonant path 220 may be resonant with a second band (e.g., a high band). In an embodiment, the length of first resonance path 210 is configured to be resonant at the lowest frequency of a half wavelength of the first band and the length of second resonant path 220 is configured to be resonant at a lowest frequency of the half wavelength of the second band.

Thus, the slot antenna can use a single closed slot 130 forming two separate resonance paths 210 and 220, and thus can produce two separate resonant modes. Consequently, high and low frequency characteristics of the slot antenna can be controlled and adjusted independently, thereby helping to enhance the slot antenna radiation characteristics, thereby enhancing the communication quality of mobile communication device 10.

In FIGS. 1 and 2, first feed portion 121 is in the form of an inverted L, and second feed portion 122 has a linear shape. Those skilled in the art will readily appreciate that feed element portion shapes or patterns employed and depicted for first feed portion 121 and second feed portion 122 are not meant to be limiting, and other shapes are possible and would be consistent with the principles of the present invention.

Figure 3:
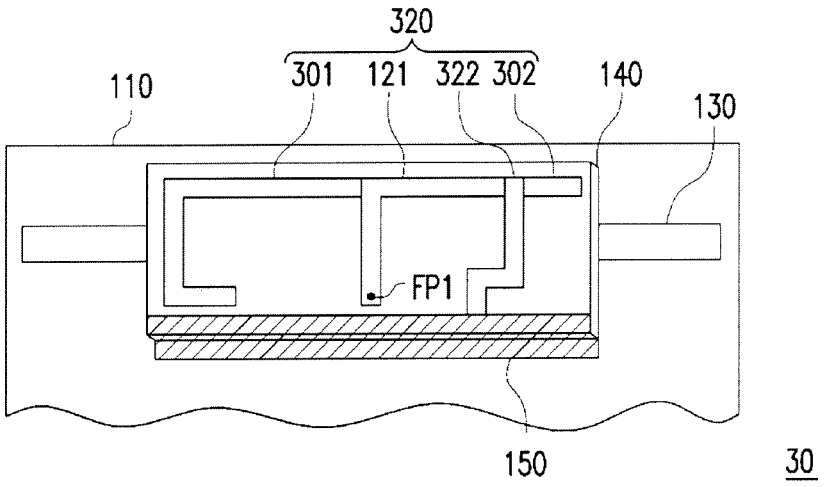
FIG. 3 is a perspective view of a mobile communication device antenna according to another embodiment of the present invention.

For example, FIG. 3 is a perspective view of a mobile communication device antenna according to another embodiment of the present invention. The mobile communication device antenna 30 of FIG. 3 is similar to that shown in FIGS. 1 and 2 except that a feed element 320 further includes third and fourth feed portions 301 and 302. In addition, second feed portion 322 is depicted as having a non-linear shape. As with first and second feed portions 121 and 302, third feed portion 301 and fourth feed portion 302 are disposed on the first surface of the substrate 140. Further, third feed portion 301 has one end that is electrically connected to first feed portion 121, and third feed portion 301's other end is an open end.

Fourth feed portion 302 has one end that is electrically connected to one end of second feed portion 322, and has another end that is an open end.

Figure 4:
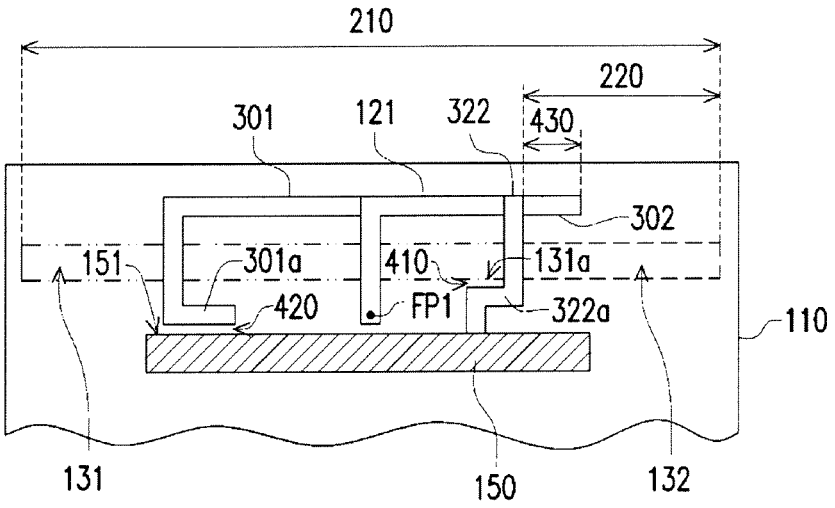
FIG. 4 is a schematic diagram of the mobile communication device antenna of FIG. 3.

FIG. 4 is a schematic diagram of the mobile communication device antenna of FIG. 3, but does not include a depiction of substrate 140. As shown in FIG. 4, second feed portion 322 includes multiple interconnected segments, including an intermediate segment 322*a*. Intermediate segment 322*a* includes a side wall 131*a* that is spaced from slot 131 by a coupling 410. Intermediate segment 322*a* can be used to adjust the slot antenna impedance in the second frequency band. Further, third feed portion 301 is disposed across first slot 131, and has a segment 301*a* that is parallel to shorting element portion 150 and spaced therefrom by coupling 420.

More specifically, third feeding 301 includes multiple segments, at least one of which spans first slot 131 and another that forms coupling section 301*a*. Coupling segment 301*a* and shorting member 150 are coupled to edge 151 of shorting element a distance 420 apart. With such a configuration, third feed portion 301 may be used to adjust the center frequency of the first frequency band. For example, a first band center frequency f0 can be adjusted by adding an initial frequency fi along with a frequency offset Δf, such that f0=fi+Δf. Initial frequency fi, can be established by the combined length of first slot 131 and second slot 132, i.e., the length of first resonance path 210, and the length of third feed 301 can define the frequency offset Δf. That is, when feed portion 301 length is longer, the first frequency band center frequency f0 will relatively decrease. In contrast, when third feed portion 301 is shorter, the first band center frequency f0 will relatively increase.

Fourth feed portion 302 can be used to form a third resonance path 430, to cause mobile communication device antenna 30 to be further operable in a third band. For example, under the excitation of the feed signal, the slot antenna can produce more third resonance modes through the third resonance path 430, e.g., yet another high-frequency mode, to thereby cover a third frequency band. In this configuration, third resonance path 430's length can be set to be resonant at the third band's lowest quarter wavelength. Furthermore, the slot antenna can make use of the second harmonic resonance mode to cover a fourth band, e.g., still another high-frequency mode. The slot antenna will transmit through the second frequency band, a third band and the fourth band's combination to extend the frequency range of the high-frequency portion.

Figure 5:
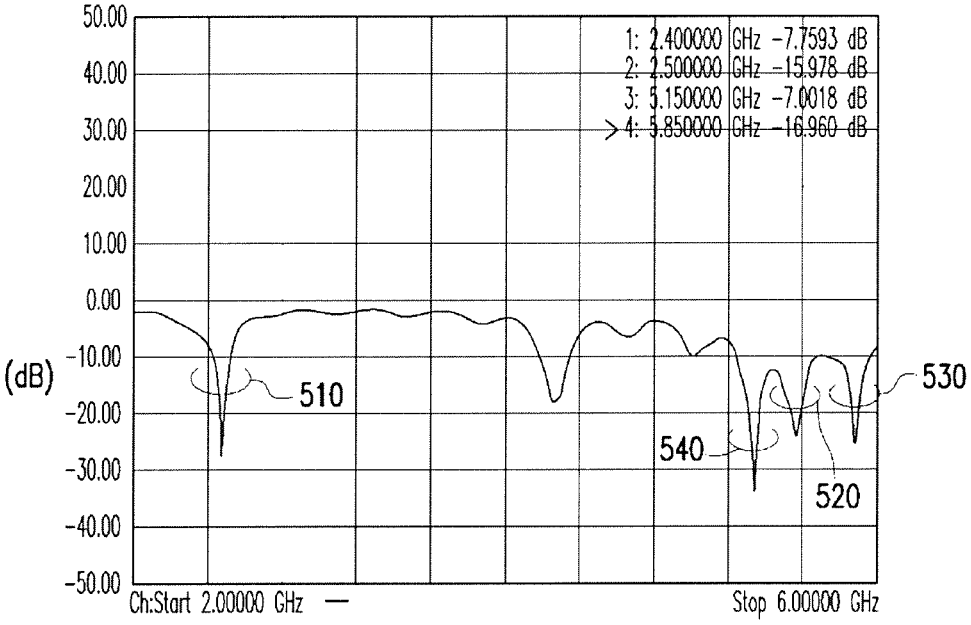
FIGS. 5 and 6 are graphs showing the performance of the mobile communication device antenna of FIG. 3.
Figure 6:
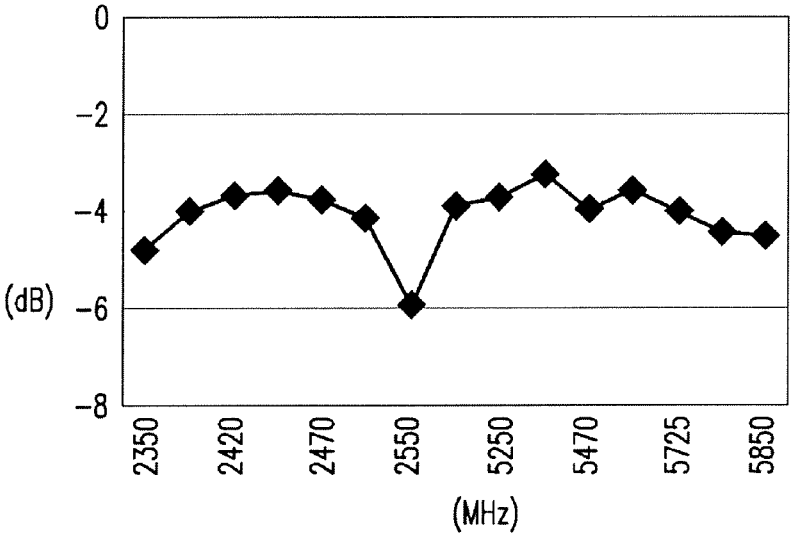

For example, FIGS. 5 and 6 are graphs showing the performance of the mobile communication device antenna 30 of FIG. 3. In FIGS. 5 and 6, feed element 320 has dimensions of 25×10 $mm^2$, and the closed slot dimension is 40×2 $mm^2$. Further, as shown in FIG. 5, the slot antenna can operate via first resonance path 210, second resonance path 220 and third resonance path 430, and thus operate in first band 510, second band 520 and third band 530. In addition, such a slot antenna can make use of the second harmonic resonance mode in a first state to cover a fourth band 540.

Through the second band 520, third band 530 and fourth band 540's combination, slot antenna can be configured to cover communication in the bandwidth including 5150 MHz~5850 MHz, which is in accordance with the IEEE 802.11ac standard. Furthermore, the first frequency band 510 of the slot antenna can cover the frequency range of the low-frequency portion of the 2.4 GHz band, and the slot antenna has good impedance matching at the first frequency band 510. Further, as shown in FIG. 6, the slot antenna can be maintained at about −3.5 dB over an extended high frequency range.

In summary, the present invention provides for the use of a unique feed element for a slot antenna. This unique feed element includes a portion that is disposed across a closed slot metal member, and has portions that electrically connect to the metal member. Furthermore, the closed slot employs a combination of a first slot and a second slot to form a first resonance path and a second resonance path. With such a configuration, the slot antenna can use the first resonance path and the second resonance path to operate in two independent resonant modes, such that high and low-frequency characteristics of the slot antenna can be controlled independently or adjusted respectively, thereby helping to enhance the slot antenna radiation characteristics.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. An antenna, comprising:

a metal member;

a closed slot disposed in the metal member;

a feed element having a first feed portion and a second feed portion, the first and second feed portions fully crossing the closed slot, and being electrically connected to each other;

a shorting member that electrically connects the second feed portion to the metal member, and a third feed portion electrically connected to the first feed portion and comprising a segment that is spaced from the shorting member by a predetermined distance.

2. The antenna of claim 1, wherein the feed element comprises a substrate, a first surface of the substrate having the first feed portion and the second feed portion disposed thereon, and a second surface of the substrate being in contact with the metal member.

3. The antenna of claim 2, further comprising a shorting member that electrically connects the second feed portion to the metal member.

4. The antenna of claim 1, wherein the first feed portion is L-shaped and the second feed portion has a linear shape, wherein a first branch of the L-shaped first feed portion fully crosses the closed slot.

5. The antenna of claim 1, wherein the second feed portion operates to split the closed slot into a first slot and a second slot, the first slot and the second slot being configured to resonate together at a first resonant frequency, and the second slot being configured to resonate at a second resonant frequency higher than the first resonant frequency.

6. The antenna of claim 1, wherein the first feed portion comprises a feed point configured to receive a feed signal that drives the closed slot.

7. The antenna of claim 1, further comprising a fourth feed portion that extends parallel to the closed slot.

8. The antenna of claim 1, wherein at least one of the resonant frequencies falls within a frequency band in which communication according to the IEEE 802.11ac standard operates.

9. The antenna of claim 1, wherein the second feed portion has a non-linear shape, and a segment thereof extends parallel to the closed slot.

10. The antenna of claim 1, wherein the metal member is a cover of a mobile communication device.

11. A mobile communication device, comprising:

a metal cover, a closed slot disposed in the metal cover;

a feed element having a first feed portion and a second feed portion, the first and second feed portions fully crossing the closed slot, and being electrically connected to each other; and a shorting member that electrically connects the second feed portion to the metal member, and a third feed portion electrically connected to the first feed portion and comprising a segment that is spaced from the shorting member by a predetermined distance.

12. The mobile communication device of claim 11, wherein the feed element comprises a substrate, a first surface of the substrate having the first feed portion and the second feed portion disposed thereon, and a second surface of the substrate being in contact with the metal cover.

13. The mobile communication device of claim 12, further comprising a shorting member that electrically connects the second feed portion to the metal member.

14. The mobile communication device of claim 11, wherein the first feed portion is L-shaped and the second feed portion has a linear shape, wherein a first branch of the L-shaped first feed portion fully crosses the closed slot.

15. The mobile communication device of claim 11, wherein the second feed portion operates to split the closed slot into a first slot and a second slot, the first slot and the second slot being configured to resonate together at a first resonant frequency, and the second slot being configured to resonate at a second resonant frequency higher than the first resonant frequency.

16. The mobile communication device of claim 11, wherein the first feed portion comprises a feed point configured to receive a feed signal that drives the closed slot.

17. The mobile communication device of claim 11, further comprising a fourth feed portion that extends parallel to the closed slot.

18. The mobile communication device of claim 17, wherein at least one of the resonance frequencies falls within a frequency band in which communication according to the IEEE 802.11ac standard operates.

* * * * *